US012697521B2

(12) United States Patent
Panapitiya

(10) Patent No.: US 12,697,521 B2
(45) Date of Patent: Aug. 4, 2026

(54) ENHANCED YOGA BLOCK CUSHION SYSTEM

(71) Applicant: Randhi Lochana Panapitiya, Seattle, WA (US)

(72) Inventor: Randhi Lochana Panapitiya, Seattle, WA (US)

( * ) Notice: Subject to any disclaimer, the term of this patent is extended or adjusted under 35 U.S.C. 154(b) by 111 days.

(21) Appl. No.: 18/776,884

(22) Filed: Jul. 18, 2024

(65) Prior Publication Data

US 2025/0025731 A1 Jan. 23, 2025

Related U.S. Application Data

(60) Provisional application No. 63/577,218, filed on Jul. 19, 2023.

(51) Int. Cl.
*A63B 21/00* (2006.01)

(52) U.S. Cl.
CPC ..... *A63B 21/00047* (2013.01)

(58) Field of Classification Search
CPC ..... A63B 21/00047; A63B 21/4037
See application file for complete search history.

(56) References Cited

U.S. PATENT DOCUMENTS 1,469,523 A * 10/1923 Mcgarvey ..... A47G 9/0253 5/490
4,480,347 A * 11/1984 Hawkins ..... A47G 9/0253 5/490
6,234,577 B1 * 5/2001 Ruppert ..... A47C 3/16 297/452.17
D887,505 S * 6/2020 Tumpson ..... D21/686
11,141,009 B1 * 10/2021 Rane ..... A47G 9/10
11,260,271 B2 * 3/2022 Mariano ..... B32B 29/02
D969,937 S * 11/2022 de Jong ..... D21/662
11,723,469 B2 * 8/2023 Fowler ..... A47C 9/00 297/452.48
12,053,112 B1 * 8/2024 Taylor ..... A47G 9/1045
2001/0003219 A1 * 6/2001 Chou ..... A47G 9/0253 5/636
2004/0192523 A1 * 9/2004 Wu ..... A63B 21/4037 482/148
2007/0271703 A1 * 11/2007 Matthews Brown .. A47D 13/08 5/636
2009/0062093 A1 * 3/2009 Clark ..... A63B 21/00047 482/148
2009/0276957 A1 * 11/2009 Boitet-Ball ..... A63B 71/0036 224/264
2012/0260421 A1 * 10/2012 DeGregorio ..... A47G 27/0206 53/473

(Continued)

*Primary Examiner* — Sundhara M Ganesan
(74) *Attorney, Agent, or Firm* — Grandview Law

(57) ABSTRACT

A cushion system for a yoga block includes (I) a cushion; (II) a cushion cover assembly including (A) a lower base portion, (B) an upper base portion, and (C) an multisided portion extending perpendicular to the lower base portion; and (III) a multisided yoga block cover assembly extending from the multisided portion of the cushion cover, wherein the cushion cover assembly is removably couplable with the cushion, and wherein the multisided yoga block cover assembly is removably couplable with the yoga block. Other aspects are described in the claims, drawings, and text forming a part of the present disclosure.

20 Claims, 7 Drawing Sheets

(56) References Cited

U.S. PATENT DOCUMENTS

2012/0304382 A1* 12/2012 Sole ..... A47G 27/0206 5/487
2015/0126340 A1* 5/2015 White ..... A63B 21/06 482/93
2015/0144519 A1* 5/2015 Tapper ..... A47F 7/0021 206/486
2015/0258363 A1* 9/2015 Kampinski ..... A63B 21/00047 482/139
2016/0220048 A1* 8/2016 Lacroix ..... A47G 9/0253
2016/0317897 A1* 11/2016 Mariano ..... B32B 3/30
2018/0008064 A1* 1/2018 DuDonis ..... A47G 9/10
2018/0272180 A1* 9/2018 Abrahams ..... A63B 21/4037
2019/0002271 A1* 1/2019 Beliveau ..... C09D 133/08
2019/0191895 A1* 6/2019 Shek ..... A47G 9/007
2019/0320798 A1* 10/2019 Bly ..... A47G 9/0253
2019/0343305 A1* 11/2019 Cubbler ..... A47G 9/0253
2020/0178709 A1* 6/2020 Brown ..... G09F 23/00
2020/0253386 A1* 8/2020 Anderson ..... A47G 9/0253
2020/0276489 A1* 9/2020 Mariano ..... A47C 31/10
2020/0282284 A1* 9/2020 Searcy ..... A45C 13/30
2020/0288877 A1* 9/2020 Duong ..... A47C 7/425
2021/0077855 A1* 3/2021 Walko ..... A61H 19/50
2021/0101046 A1* 4/2021 Naves ..... A61F 7/02
2021/0127868 A1* 5/2021 Duong ..... A47G 9/0253
2021/0386222 A1* 12/2021 O'Veal ..... A47G 9/0253
2022/0039569 A1* 2/2022 Smith ..... A47G 9/0253
2022/0110464 A1* 4/2022 Sutton ..... A45C 7/0059
2022/0212084 A1* 7/2022 Yee ..... A63B 71/0036
2023/0019080 A1* 1/2023 Reisman ..... A47G 9/0253
2023/0059540 A1* 2/2023 Robinson ..... A47C 31/007
2023/0148772 A1* 5/2023 Boehlen ..... A47G 9/1081 5/636
2023/0347203 A1* 11/2023 Morris ..... A47G 9/10
2024/0033561 A1* 2/2024 Ruse ..... A63B 71/0036
2024/0130547 A1* 4/2024 Chorny ..... A47G 9/0253
2024/0374954 A1* 11/2024 Growald ..... A63B 21/4039
2025/0049217 A1* 2/2025 Zimmer ..... A47C 7/0213

* cited by examiner

ENHANCED YOGA BLOCK CUSHION SYSTEM

SUMMARY

In one or more aspects a cushion system for a yoga block includes (I) a cushion; (II) a cushion cover assembly including (A) a lower base portion, (B) an upper base portion, and (C) an multisided portion extending perpendicular to the lower base portion; and (III) a multisided yoga block cover assembly extending from the multisided portion of the cushion cover, wherein the cushion cover assembly is removably couplable with the cushion, and wherein the multisided yoga block cover assembly is removably couplable with the yoga block. In implementations the yoga block includes a yoga block height, wherein the cushion includes a cushion height, and the cushion height is less than half of the yoga block height. In implementations the multisided portion of the cushion cover assembly includes at least one inner material layer portion and at least one outer material layer portion. In implementations the cushion cover assembly includes at least one of the following materials: cotton, silk, wool, bamboo, and polyethylene terephthalate. In implementations the multisided yoga block cover assembly includes at least one inner material layer portion, at least one middle material layer portion, and at least one outer material layer portion. In implementations the multisided yoga block cover assembly includes at least one of the following materials: rubber, neoprene, foam, vinyl, silicone, and high density polyethylene. In implementations the cushion includes at least one rectangular shape. In implementations the multisided yoga block cover assembly includes at least one rectangular shape when coupled with the yoga block. In implementations the lower base portion of the cushion cover assembly includes an overlap closure portion to allow for insertion of the cushion into and removal of the cushion from the cushion cover assembly. In implementations the multisided yoga block cover assembly includes yoga block fastening portion, and wherein the yoga block fastening portion includes an elastic portion. In implementations the yoga block includes a plurality of side portions, and wherein the multisided yoga block cover assembly is sized and shaped to partially cover at least one side portion of the plurality of side portions of the yoga block when the multisided yoga block cover assembly is coupled with the yoga block. In implementations the yoga block includes an upper base portion and at least one side portion, wherein the multisided yoga block cover assembly is sized and shaped to fully cover the at least one side portion of the yoga block when the multisided yoga block cover assembly is coupled with the yoga block, and wherein the lower base portion of the cushion cover assembly is sized and shaped to fully cover the upper base portion of the yoga block when the multisided yoga block cover assembly is coupled with the yoga block. In implementations the yoga block includes a lower base portion, and wherein the multisided yoga block cover assembly is sized and shaped to cover at least a portion of the lower base of the yoga block when the multisided yoga block cover assembly is coupled with the yoga block. In implementations the multisided yoga block cover assembly includes at least one of the following materials: rubber, neoprene, foam, vinyl, silicone, and high density polyethylene.

In one or more aspects a system includes (I) a cushion; (II) a cushion cover assembly including (A) a lower base portion, (B) an upper base portion, and (C) an multisided portion extending perpendicular to the lower base portion; (III) a multisided yoga block cover assembly extending from the multisided portion of the cushion cover; and (IV) a yoga block, wherein the cushion cover assembly is removably couplable with the cushion, and wherein the multisided yoga block cover assembly is removably couplable with the yoga block. In implementations the yoga block includes an upper base portion and at least one side portion, wherein the multisided yoga block cover assembly is sized and shaped to fully cover the at least one side portion of the yoga block when the multisided yoga block cover assembly is coupled with the yoga block, and wherein the lower base portion of the cushion cover assembly is sized and shaped to fully cover the upper base portion of the yoga block when the multisided yoga block cover assembly is coupled with the yoga block. In implementations the yoga block includes a plurality of side portions, and wherein the multisided yoga block cover assembly is sized and shaped to partially cover at least one side portion of the plurality of side portions of the yoga block when the multisided yoga block cover assembly is coupled with the yoga block.

In one or more aspects a cushion system for a cushion and a yoga block includes (I) a cushion cover assembly including (A) a lower base portion, (B) an upper base portion, and (C) an multisided portion extending perpendicular to the lower base portion; and (II) a multisided yoga block cover assembly extending from the multisided portion of the cushion cover; and wherein the cushion cover assembly is removably couplable with the cushion, and wherein the multisided yoga block cover assembly is removably couplable with the yoga block. In implementations the yoga block includes a plurality of side portions, and wherein the multisided yoga block cover assembly is sized and shaped to partially cover at least one side portion of the plurality of side portions of the yoga block when the multisided yoga block cover assembly is coupled with the yoga block. In implementations the yoga block includes an upper base portion and at least one side portion, wherein the multisided yoga block cover assembly is sized and shaped to fully cover the at least one side portion of the yoga block when the multisided yoga block cover assembly is coupled with the yoga block, and wherein the lower base portion of the cushion cover assembly is sized and shaped to fully cover the upper base portion of the yoga block when the multisided yoga block cover assembly is coupled with the yoga block.

In addition to the foregoing, other aspects are described in the claims, drawings, and text forming a part of the disclosure set forth herein. Various other aspects are set forth and described in the teachings such as text (e.g., claims and/or detailed description) and/or drawings of the present disclosure. The foregoing is a summary and thus may contain simplifications, generalizations, inclusions, or omissions of detail; consequently, those skilled in the art will appreciate that the summary is illustrative only and is NOT intended to be in any way limiting. Other aspects, features, and advantages of the devices and/or processes and/or other subject matter described herein will become apparent in the teachings set forth herein.

BRIEF DESCRIPTION OF THE FIGURES

For a more complete understanding of implementations, reference now is made to the following descriptions taken in connection with the accompanying drawings. The use of the same symbols in different drawings typically indicates similar or identical items, unless context dictates otherwise.

Figure 1:
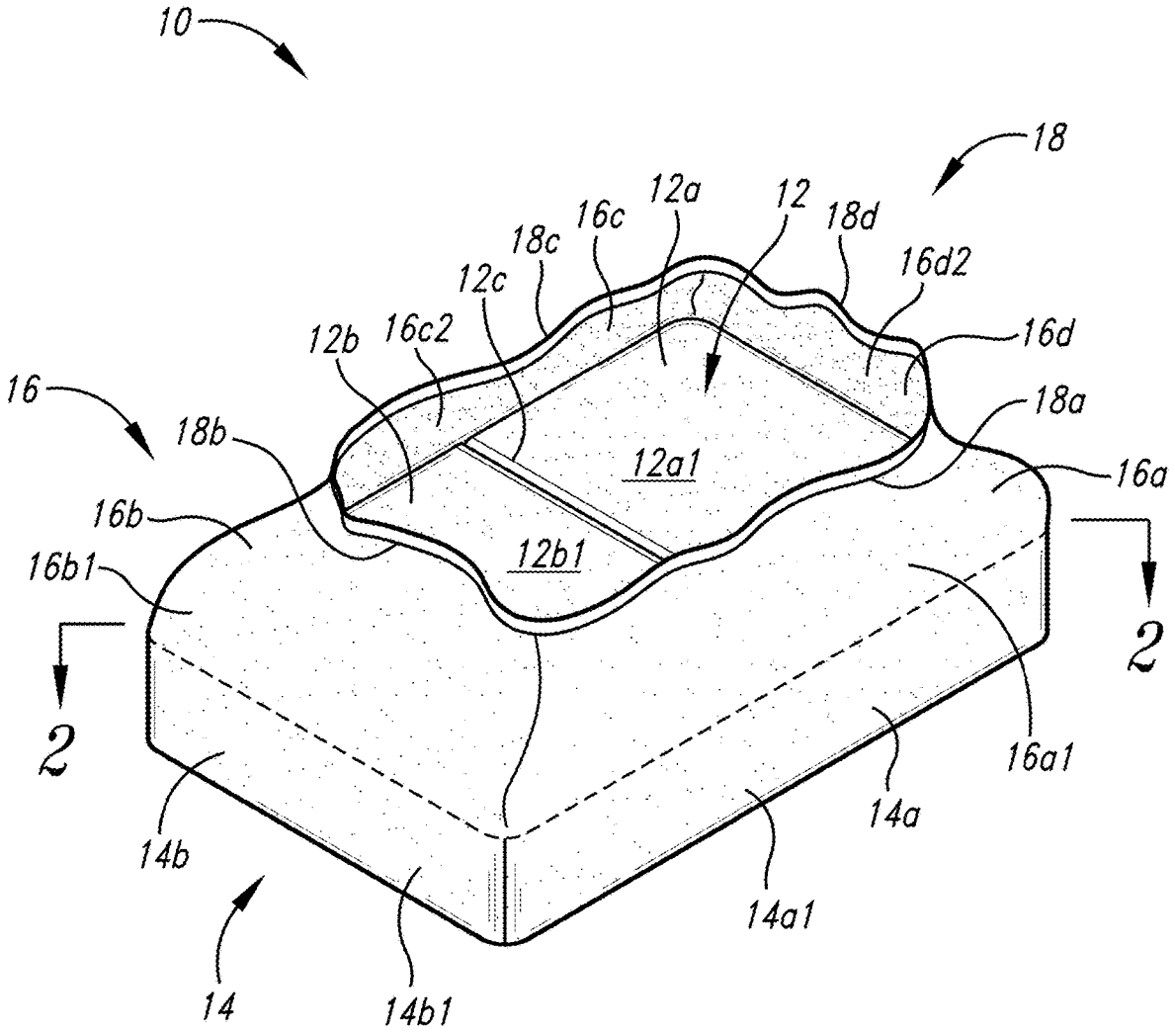
FIG. 1 is a rear perspective view of a yoga block cushion system.

With reference now to the figures, shown are one or more examples of Enhanced Yoga Block Cushion System, articles of manufacture, compositions of matter for same that may provide context, for instance, in introducing one or more processes and/or devices described herein.

DETAILED DESCRIPTION

In the following detailed description, reference is made to the accompanying drawings, which form a part hereof. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here.

Turning to FIG. 1, depicted therein is a rear perspective view of yoga block cushion system 10.

Depicted implementation of yoga block cushion system 10 is shown to include cushion cover assembly lower base portion 12, cushion cover assembly multisided portion 14, multisided yoga block cover assembly portion 16, and yoga block fastening portion 18.

Depicted implementation of cushion cover assembly lower base portion 12 is shown to include partial lower base portion 12*a* with outer material layer portion 12*a*1 (e.g., textured, non textured, rubber, neoprene, foam, vinyl, silicone, high density polyethylene (HDPE), etc.), and partial lower base portion 12*b* with outer material layer portion 12*b*1 (e.g., textured, non textured, rubber, neoprene, foam, vinyl, silicone, HDPE, etc.), and overlap closure portion 12*c* (e.g., seam, elastic, zipper, or hook and loop (e.g., Velcro®), etc.), which can be used to insert cushion 20 into and remove cushion 20 from yoga block cushion system 10

Depicted implementation of cushion cover assembly multisided portion 14 is shown to include side portion 14*a* with outer material layer portion 14*a*1 (e.g., textured, non textured, rubber, neoprene, foam, vinyl, silicone, HDPE, etc.) and side portion 14*b* with outer material layer portion 14*b*1 (e.g., textured, non textured, rubber, neoprene, foam, vinyl, silicone, HDPE, etc.).

Depicted implementation of multisided yoga block cover assembly portion 16 is shown to include side portion 16*a* with outer material layer portion 16*a*1 (e.g., textured, non textured, rubber, neoprene, foam, vinyl, silicone, HDPE, etc.), side portion 16*b* with outer material layer portion 16*b*1 (e.g., textured, non textured, rubber, neoprene, foam, vinyl, silicone, HDPE, etc.), side portion 16*c* with inner material layer portion 16*c*2 (e.g., textured, non textured, rubber, neoprene, foam, vinyl, silicone, HDPE, etc.), and side portion 16*d* with 16*d*2 (e.g., textured, non textured, rubber, neoprene, foam, vinyl, silicone, HDPE, etc.).

Depicted implementation of yoga block fastening portion 18 is shown to include side portion 18*a* and side portion 18*b*, side portion 18*c*, and side portion 18*d* (e.g., elastic, drawcord, zipper, or hook and loop (e.g., Velcro®), etc.).

Figure 2:
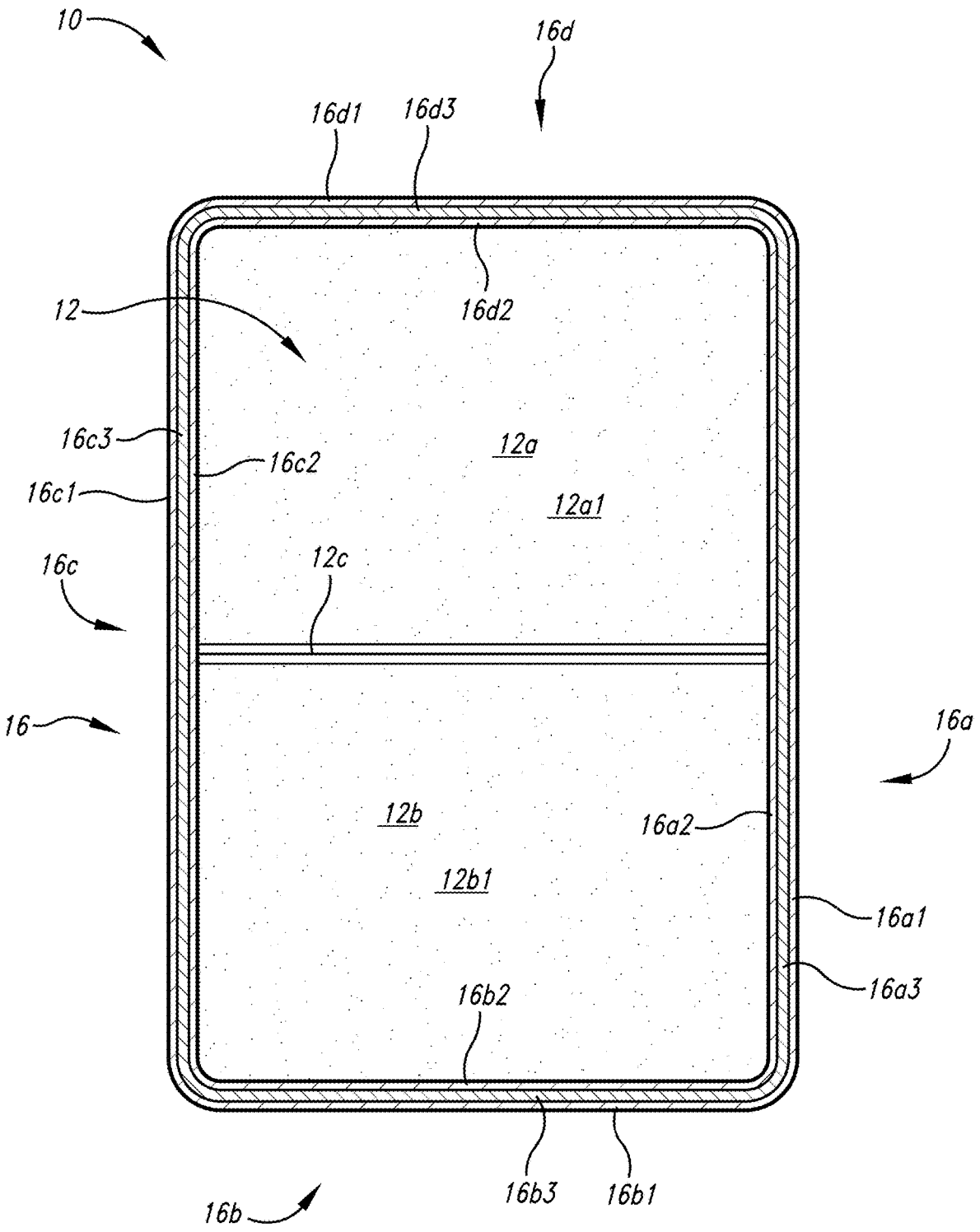
FIG. 2 is a rear plan cross-sectional view of a yoga block cushion system taken along the 2-2 cutline of FIG. 1.

Turning to FIG. 2, depicted therein is a rear plan cross-sectional view of yoga block cushion system 10 taken along the 2-2 cutline of FIG. 1.

Depicted implementation of side portion 16*a* is shown to include inner material layer portion 16*a*2 (e.g., textured, non textured, rubber, neoprene, foam, vinyl, silicone, HDPE, etc.) and middle material layer portion 16*a*3 (e.g., cotton, silk, wool, bamboo, polyethylene terephthalate, etc.).

Depicted implementation of side portion 16*b* is shown to include inner material layer portion 16*b*2 (e.g., textured, non textured, rubber, neoprene, foam, vinyl, silicone, HDPE, etc.) and middle material layer portion 16*b*3 (e.g., cotton, silk, wool, bamboo, polyethylene terephthalate, etc.).

Depicted implementation of side portion 16*c* is shown to include outer material layer portion 16*c*1 (e.g., textured, non textured, rubber, neoprene, foam, vinyl, silicone, HDPE, etc.) and middle material layer portion 16*c*3 (e.g., cotton, silk, wool, bamboo, polyethylene terephthalate, etc.).

Depicted implementation of side portion 16*d* is shown to include outer material layer portion 16*d*1 (e.g., textured, non textured, rubber, neoprene, foam, vinyl, silicone, HDPE, etc.) and middle material layer portion 16*d*3 (e.g., cotton, silk, wool, bamboo, polyethylene terephthalate, etc.).

Figure 3:
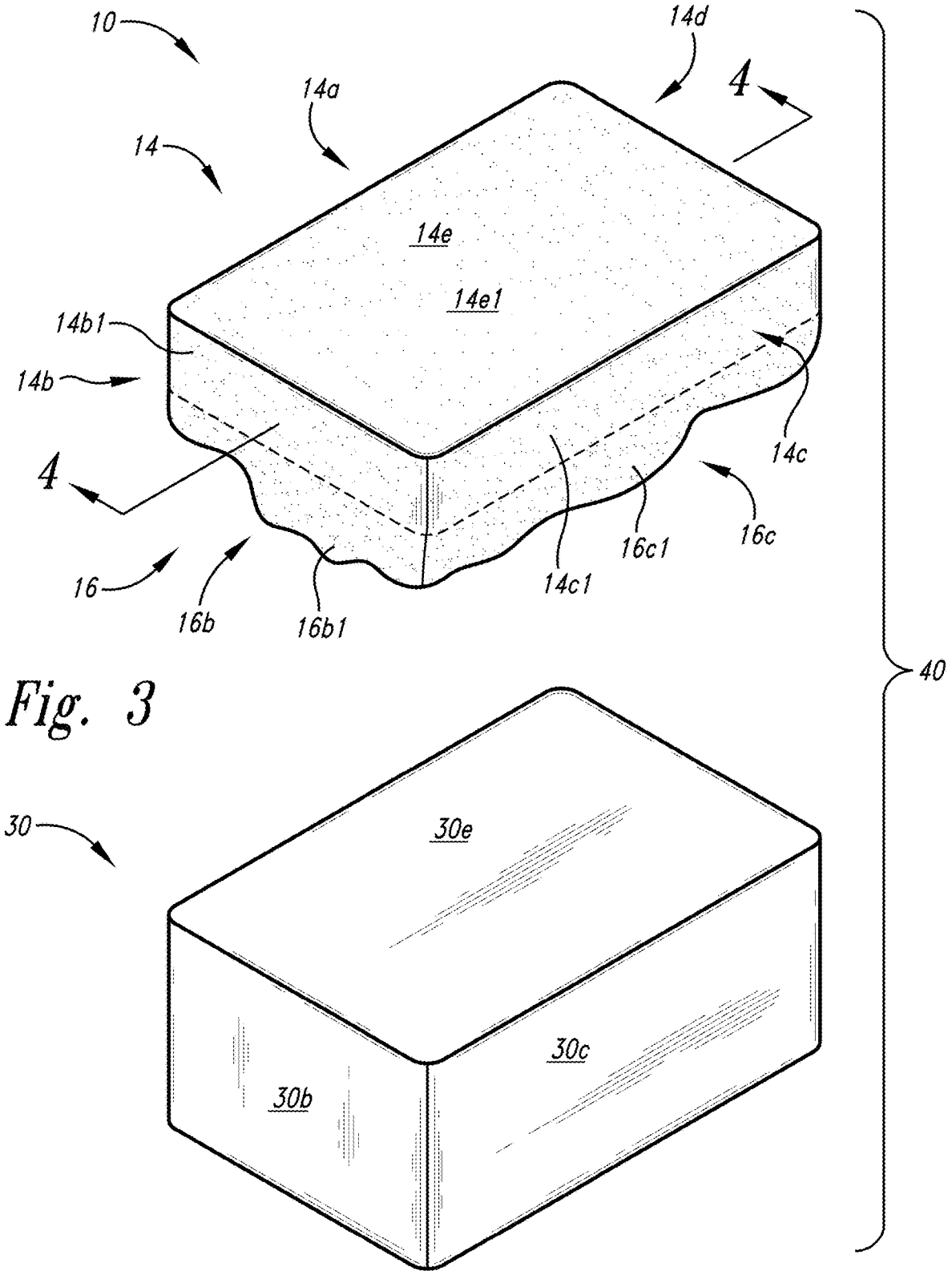
FIG. 3 is a partial front perspective view of the yoga block cushion system of FIG. 1 with a yoga block uncoupled from the yoga block cushion system.

Turning to FIG. 3, depicted therein is a partial front perspective view of yoga block cushion system 10 with yoga block 30 uncoupled from yoga block cushion system 10 as cushion system-yoga block assembly 40.

Depicted implementation of cushion cover assembly multisided portion 14 is shown to include side portion 14*c* with outer material layer portion 14*c*1 (e.g., textured, non textured, rubber, neoprene, foam, vinyl, silicone, HDPE, etc.), side portion 14*d*, and upper base portion 14*e* with outer material layer portion 14*e*1 (e.g., textured, non textured, rubber, neoprene, foam, vinyl, silicone, HDPE, etc.).

Depicted implementation of yoga block 30 (e.g., latex, ethylene-vinyl acetate copolymer (EVA), cork, other non-latex foam, etc.) is shown to include side portion 30*b*, side portion 30*c*, and upper base portion 30*e*. In some implementations dimensions can include four inches wide by nine inches long by nine inches high.

Figure 4:
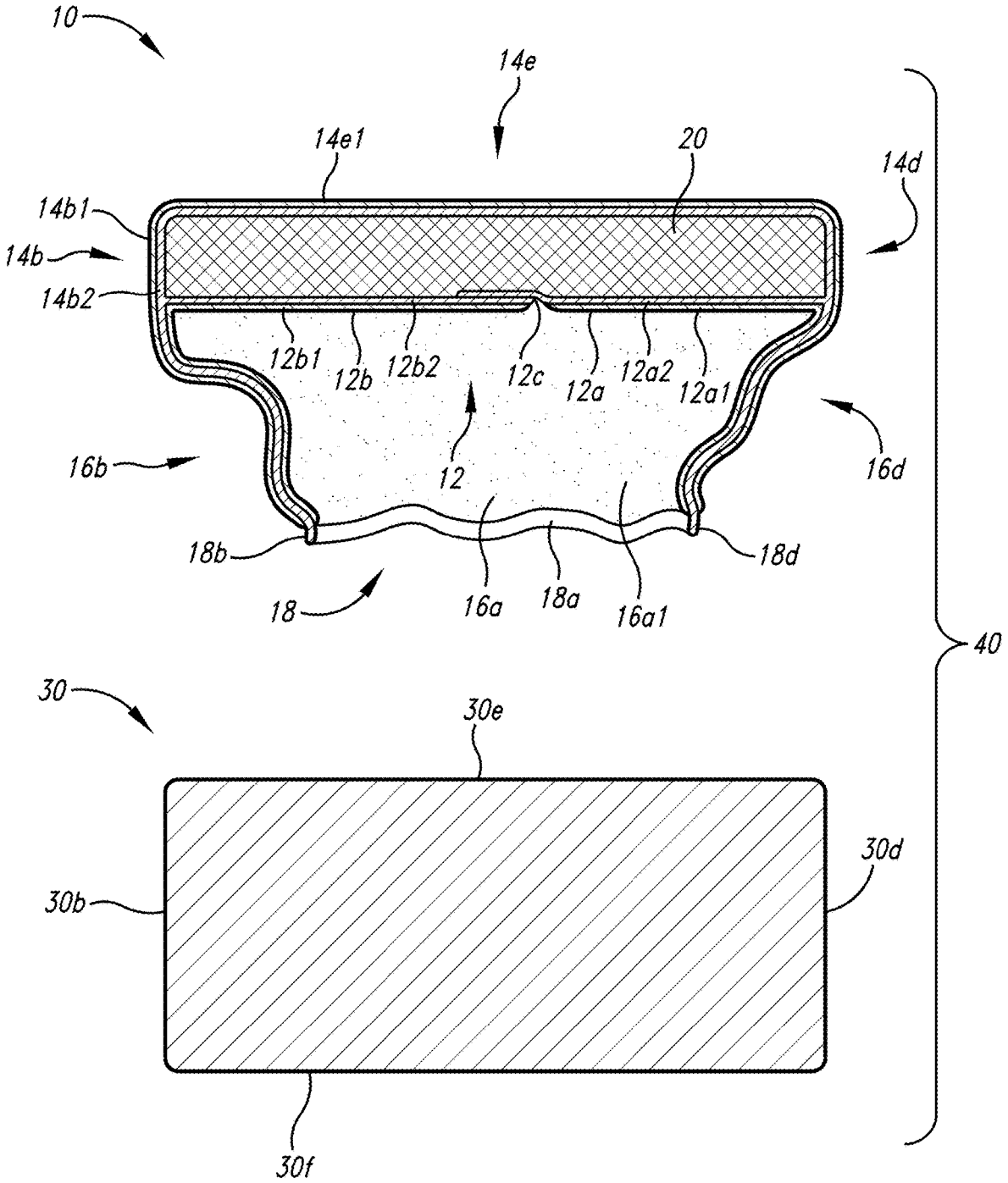
FIG. 4 is a side elevational cross-sectional view of the yoga block cushion system of FIG. 1 with the yoga block of FIG. 3 uncoupled from the yoga block cushion system taken along the 4-4 cutline of FIG. 3.

Turning to FIG. 4, depicted therein is a side elevational cross-sectional view of yoga block cushion system 10 with yoga block 30 from yoga block cushion system 10 taken along the 4-4 cutline of FIG. 3.

Depicted implementation of partial lower base portion 12*a* is shown to include inner material layer portion 12*a*2 (e.g., cotton, silk, wool, bamboo, polyethylene terephthalate, etc.) and inner material layer portion 12*b*2 (e.g., cotton, silk, wool, bamboo, polyethylene terephthalate, etc.).

Depicted implementation of cushion cover assembly multisided portion 14 is shown to include inner material layer portion 14*b*2 (e.g., cotton, silk, wool, bamboo, polyethylene terephthalate, etc.).

Depicted implementation of yoga block cushion system 10 is shown to include cushion 20 (e.g., latex or non-latex foam, wool, rubber, down, inflatable, grain-based, coconut fiber, buckwheat, rice hulls, hemp, bamboo fiber, etc.). In some implementations dimensions of cushion 20 can include six inches in width by nine inches in length by at least one inch in height.

Depicted implementation of yoga block 30 is shown to include side portion 30*d* and lower base portion 30*f*.

Figure 5:
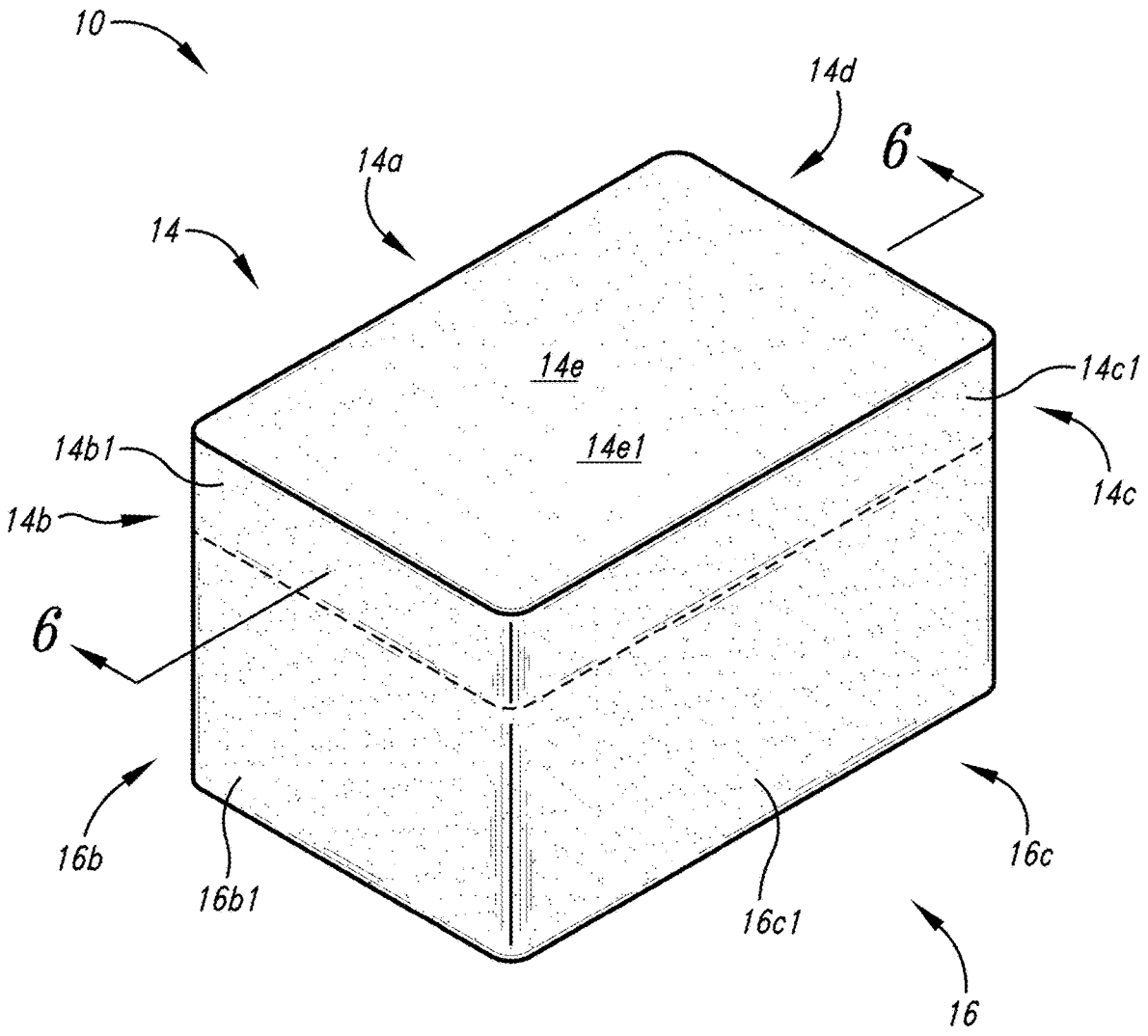
FIG. 5 is a front perspective view of the yoga block cushion system of FIG. 1 coupled with the yoga block of FIG. 3.

Turning to FIG. 5, depicted therein is a front perspective view of yoga block cushion system 10 coupled with yoga block 30.

Figure 6:
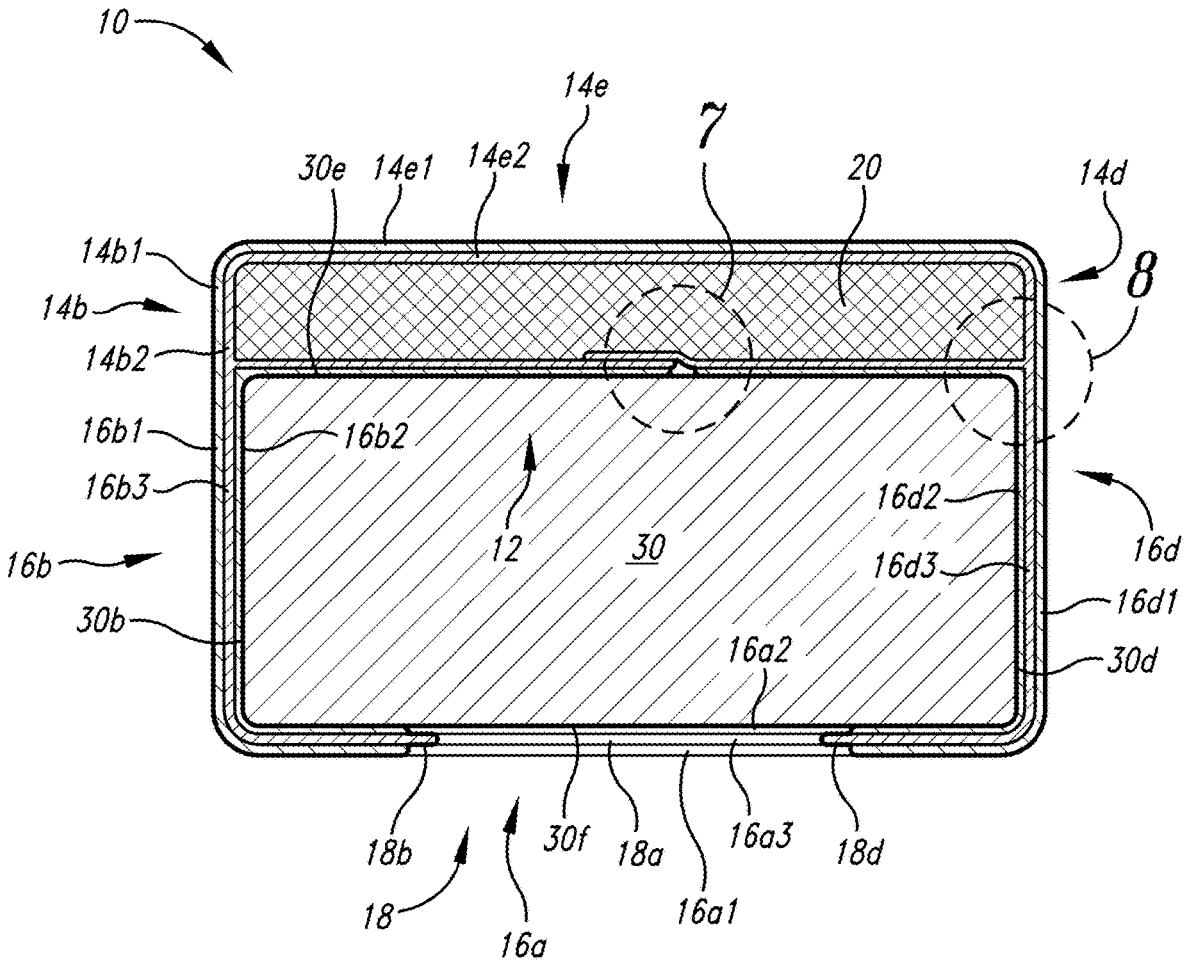
FIG. 6 is a side elevational cross-sectional view of the yoga block cushion system of FIG. 1 coupled with the yoga block of FIG. 3 taken along the 6-6 cutline of FIG. 5.

Turning to FIG. 6, depicted therein is a side elevational cross-sectional view of yoga block cushion system 10 coupled with yoga block 30 taken along the 6-6 cutline of FIG. 5.

Depicted implementation of cushion cover assembly multisided portion 14 is shown to include inner material layer portion 14*e*2 (e.g., cotton, silk, wool, bamboo, polyethylene terephthalate, etc.).

Figure 7:
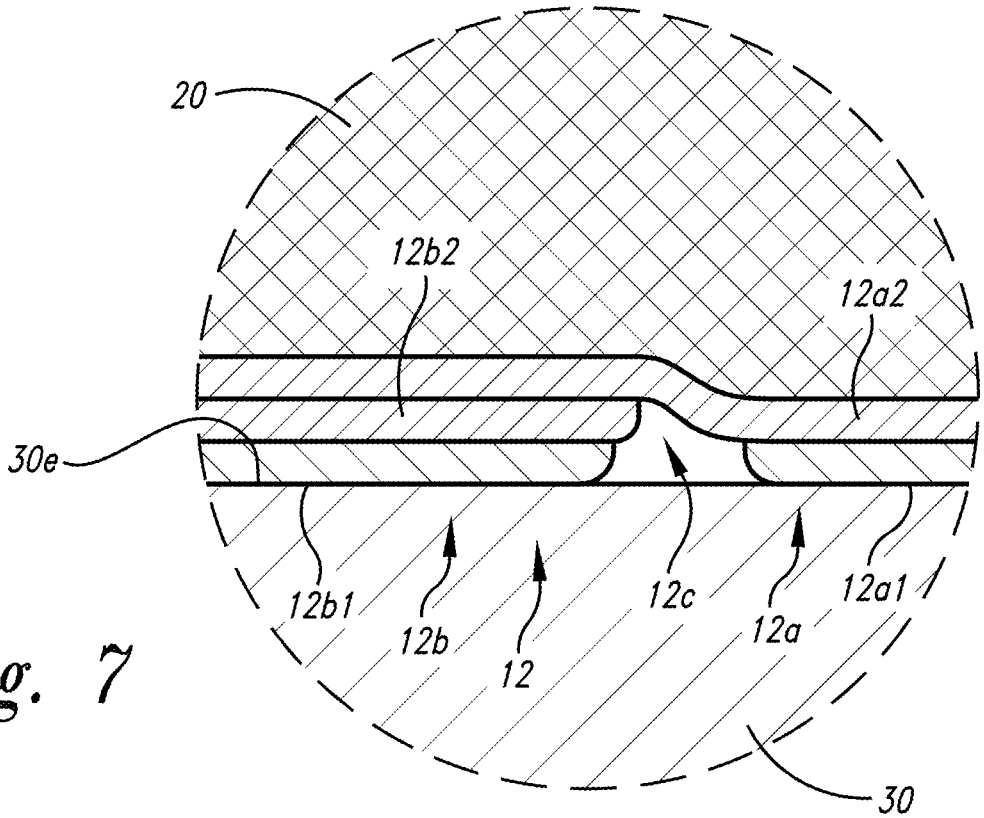
FIG. 7 is an enlarged side elevational cross-sectional view of a portion of the yoga block cushion system of FIG. 1 coupled with the yoga block of FIG. 3 taken with respect to the dashed circle labeled "7".

Turning to FIG. 7, depicted therein is an enlarged side elevational cross-sectional view of a portion of yoga block cushion system 10 coupled with yoga block 30 taken with respect to the dashed circle labeled "7".

Figure 8:
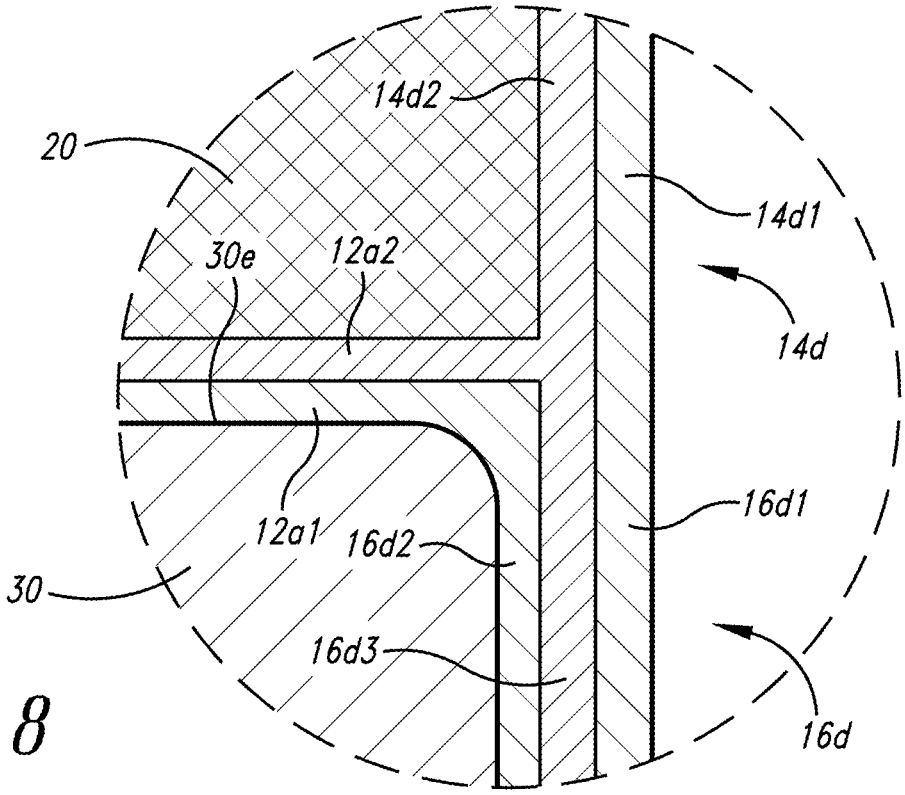
FIG. 8 is an enlarged side elevational cross-sectional view of a portion of the yoga block cushion system of FIG. 1 coupled with the yoga block of FIG. 3 taken with respect to the dashed circle labeled "8".

Turning to FIG. 8, depicted therein is an enlarged side elevational cross-sectional view of a portion of yoga block cushion system 10 coupled with yoga block 30 taken with respect to the dashed circle labeled "8".

Depicted implementation of cushion cover assembly multisided portion 14 is shown to include outer material layer portion 14*d*1 (e.g., textured, non textured, rubber, neoprene, foam, vinyl, silicone, HDPE, etc.) and inner material layer portion 14*d*2 (e.g., cotton, silk, wool, bamboo, polyethylene terephthalate, etc.).

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A cushion system for a yoga block, the cushion system comprising:

(I) a cushion;

(II) a cushion cover assembly including (A) a lower base portion including a partial lower base portion with an outer material layer portion, and a partial lower base portion with an outer material layer portion, and an overlap closure portion, wherein the overlap closure portion is disposed between the partial lower base portions, wherein the overlap closure portion comprises at least one of seam, elastic, or hook and loop, and wherein the overlap closure portion is used to insert the cushion into and remove the cushion from the yoga block cushion system, (B) an upper base portion, and (C) an multisided portion extending perpendicular to the lower base portion;

(III) a multisided yoga block cover assembly extending from the multisided portion of the cushion cover assembly, wherein the multisided yoga block cover assembly includes at least one side portion including an outer material layer portion, an inner material layer portion, and a middle material layer portion; and (IV) a yoga block fastening portion, wherein the yoga block fastening portion includes a first side portion, a second side portion, a third side portion, and a fourth side portion, wherein the yoga block fastening portion comprises at least one of elastic, drawcord, or hook and loop, wherein the cushion cover assembly is removably couplable with the cushion, and wherein the multisided yoga block cover assembly is removably couplable with the yoga block.

2. The cushion system of claim 1 wherein the cushion includes a cushion height greater or equal to one inch.

3. The cushion system of claim 1 wherein the multisided portion of the cushion cover assembly includes at least one inner material layer portion and at least one outer material layer portion.

4. The cushion system of claim 1 wherein the cushion cover assembly includes at least one of the following materials: cotton, silk, wool, bamboo, and polyethylene terephthalate.

5. The cushion system of claim 1 wherein the multisided yoga block cover assembly includes at least one inner material layer portion, at least one middle material layer portion, and at least one outer material layer portion.

6. The cushion system of claim 1 wherein the multisided yoga block cover assembly includes at least one of the following materials: rubber, neoprene, foam, vinyl, silicone, and high density polyethylene.

7. The cushion system of claim 1 wherein the cushion includes at least one rectangular shape.

8. The cushion system of claim 1 wherein the multisided yoga block cover assembly includes at least one rectangular shape when coupled with the yoga block.

9. The cushion system of claim 1 wherein the lower base portion of the cushion cover assembly includes an overlap closure portion to allow for insertion of the cushion into and removal of the cushion from the cushion cover assembly.

10. The cushion system of claim 1 wherein the multisided yoga block cover assembly includes yoga block fastening portion, and wherein the yoga block fastening portion includes an elastic portion.

11. The cushion system of claim 1 wherein the yoga block includes a plurality of side portions, and wherein the multisided yoga block cover assembly is sized and shaped to partially cover at least one side portion of the plurality of side portions of the yoga block when the multisided yoga block cover assembly is coupled with the yoga block.

12. The cushion system of claim 1 wherein the yoga block includes an upper base portion and at least one side portion, wherein the multisided yoga block cover assembly is sized and shaped to fully cover the at least one side portion of the yoga block when the multisided yoga block cover assembly is coupled with the yoga block, and wherein the lower base portion of the cushion cover assembly is sized and shaped to fully cover the upper base portion of the yoga block when the multisided yoga block cover assembly is coupled with the yoga block.

13. The cushion system of claim 1 wherein the yoga block includes a lower base portion, and wherein the multisided yoga block cover assembly is sized and shaped to cover at least a portion of the lower base of the yoga block when the multisided yoga block cover assembly is coupled with the yoga block.

14. The cushion system of claim 1 wherein the multisided yoga block cover assembly includes at least one of the following materials: rubber, neoprene, foam, vinyl, silicone, and high density polyethylene.

15. A system comprising:

(I) a cushion;

(II) a cushion cover assembly including (A) a lower base portion including a partial lower base portion with an outer material layer portion, and a partial lower base portion with an outer material layer portion, and an overlap closure portion, wherein the overlap closure portion is disposed between the partial lower base portions, wherein the overlap closure portion comprises at least one of seam, elastic, or hook and loop, and wherein the overlap closure portion is used to insert the cushion into and remove the cushion from the yoga block cushion system, (B) an upper base portion, and (C) an multisided portion extending perpendicular to the lower base portion;

(III) a multisided yoga block cover assembly extending from the multisided portion of the cushion cover assembly, wherein the multisided yoga block cover assembly includes at least one side portion including an outer material layer portion, an inner material layer portion, and a middle material layer portion;

(IV) a yoga block; and (V) a yoga block fastening portion, wherein the yoga block fastening portion includes a first side portion, a second side portion, a third side portion, and a fourth side portion, wherein the yoga block fastening portion comprises at least one of elastic, drawcord, or hook and loop, wherein the cushion cover assembly is removably couplable with the cushion, and wherein the multisided yoga block cover assembly is removably couplable with the yoga block.

16. The cushion system of claim 15 wherein the yoga block includes an upper base portion and at least one side portion, wherein the multisided yoga block cover assembly is sized and shaped to fully cover the at least one side portion of the yoga block when the multisided yoga block cover assembly is coupled with the yoga block, and wherein the lower base portion of the cushion cover assembly is sized and shaped to fully cover the upper base portion of the yoga block when the multisided yoga block cover assembly is coupled with the yoga block.

17. The cushion system of claim 15 wherein the yoga block includes a plurality of side portions, and wherein the multisided yoga block cover assembly is sized and shaped to partially cover at least one side portion of the plurality of side portions of the yoga block when the multisided yoga block cover assembly is coupled with the yoga block.

18. A cushion system for a cushion and a yoga block, the cushion system comprising:

(I) a cushion cover assembly including (A) a lower base portion including a partial lower base portion with an outer material layer portion, and a partial lower base portion with an outer material layer portion, and an overlap closure portion, wherein the overlap closure portion is disposed between the partial lower base portions, wherein the overlap closure portion comprises at least one of seam, elastic, or hook and loop, and wherein the overlap closure portion is used to insert the cushion into and remove the cushion from the yoga block cushion system, (B) an upper base portion, and (C) an multisided portion extending perpendicular to the lower base portion; and (II) a multisided yoga block cover assembly extending from the multisided portion of the cushion cover assembly, wherein the multisided yoga block cover assembly includes at least one side portion including an outer material layer portion, an inner material layer portion, and a middle material layer portion, and (III) a yoga block fastening portion, wherein the yoga block fastening portion includes a first side portion, a second side portion, a third side portion, and a fourth side portion, wherein the yoga block fastening portion comprises at least one of elastic, drawcord, or hook and loop, wherein the cushion cover assembly is removably couplable with the cushion, and wherein the multisided yoga block cover assembly is removably couplable with the yoga block.

19. The cushion system of claim 18 wherein the yoga block includes a plurality of side portions, and wherein the multisided yoga block cover assembly is sized and shaped to partially cover at least one side portion of the plurality of side portions of the yoga block when the multisided yoga block cover assembly is coupled with the yoga block.

20. The cushion system of claim 18 wherein the yoga block includes an upper base portion and at least one side portion, wherein the multisided yoga block cover assembly is sized and shaped to fully cover the at least one side portion of the yoga block when the multisided yoga block cover assembly is coupled with the yoga block, and wherein the lower base portion of the cushion cover assembly is sized and shaped to fully cover the upper base portion of the yoga block when the multisided yoga block cover assembly is coupled with the yoga block.

* * * * *